US011388960B2

(12) United States Patent
Dal Toso

(10) Patent No.: US 11,388,960 B2
(45) Date of Patent: Jul. 19, 2022

(54) SNAP BUTTON, AND A FEMALE COMPONENT FOR SUCH SNAP BUTTON

(71) Applicant: Davide Dal Toso, Padua (IT)

(72) Inventor: Davide Dal Toso, Padua (IT)

(73) Assignee: RIRI S.A., Mendrisio (CH)

( * ) Notice: Subject to any disclaimer, the term of this patent is extended or adjusted under 35 U.S.C. 154(b) by 0 days.

(21) Appl. No.: 17/022,283

(22) Filed: Sep. 16, 2020

(65) Prior Publication Data

US 2021/0100322 A1 Apr. 8, 2021

(30) Foreign Application Priority Data

Sep. 16, 2019 (IT) ..... 102019000016394

(51) Int. Cl.
*A44B 17/00* (2006.01)

(52) U.S. Cl.
CPC ..... *A44B 17/0023* (2013.01); *A44B 17/007* (2013.01); *A44B 17/0029* (2013.01); *A44B 17/0041* (2013.01); *A44B 17/0076* (2013.01)

(58) Field of Classification Search
CPC ..... A44B 17/0023; A44B 17/0029; A44B 17/0041; A44B 17/007; A44B 17/0076; A44B 17/0011
See application file for complete search history.

(56) References Cited

U.S. PATENT DOCUMENTS 1,391,250 A * 9/1921 Frankel ..... A44B 17/0011 24/673
1,402,006 A * 1/1922 Mulvey ..... A44B 17/0011 24/358
1,405,933 A * 2/1922 Mulvey ..... A44B 17/0011 24/696

(Continued)

FOREIGN PATENT DOCUMENTS

CN 201036360 Y 3/2008
EP 0248970 A1 12/1987

(Continued)

OTHER PUBLICATIONS

Italian Search Report from the Italian Patent Office issued in corresponding Italian Application No. 102019000016394, with English translation of category of cited documents dated May 19, 2020 (12 pages).

(Continued)

*Primary Examiner* — David M Upchurch
(74) *Attorney, Agent, or Firm* — Flynn Thiel, P.C.

(57) ABSTRACT

A snap button includes a male component and a female component which couple and uncouple as a result of effort in a main axial direction. The male component has a base from which there protrudes a rounded head, which is provided with a neck which is narrower than the head. The female component has a hollow body with an opening within which the head of the male component is introduced. Two flexible bars of a plastics material are mounted in the (Continued)

hollow body, the flexible bars having the ends thereof blocked. The distance between the central zones of the two flexible bars is lower than the dimension of the head of the male component so that they can be flexibly forced away from each other by a force exerted by the head of the male component and to resiliently move back towards each other when the force stops.

21 Claims, 4 Drawing Sheets

(56) References Cited

U.S. PATENT DOCUMENTS

| | | | | | |
|---|---|---|---|---|---|
| 1,455,281 | A * | 5/1923 | Baer | A44B 5/02 | 24/102 SL |
| 1,804,951 | A * | 5/1931 | Reiter | A44B 17/0011 | 24/675 |
| 2,617,165 | A | 11/1952 | Stanley et al. | | |
| 2,626,441 | A * | 1/1953 | Buren, Jr. | A44B 17/0011 | 24/676 |
| 2,626,442 | A * | 1/1953 | Blazej | A44B 17/0011 | 24/676 |
| 2,626,443 | A * | 1/1953 | Blazej | A44B 17/0011 | 24/692 |
| 2,665,468 | A * | 1/1954 | Fenton | A44B 17/0011 | 24/676 |
| 3,107,409 | A | 10/1963 | Arthaud et al. | | |
| 3,309,748 | A * | 3/1967 | Mortensen | A44B 17/0035 | 24/682.1 |
| 3,401,434 | A * | 9/1968 | Daddona, Jr. | A44B 17/0035 | 24/689 |
| 3,639,950 | A | 2/1972 | Lutz et al. | | |
| 5,758,589 | A | 6/1998 | Pommier | | |
| 2011/0041295 | A1* | 2/2011 | Reiter | A44B 17/0064 | 24/595.1 |
| 2017/0347728 | A1 | 12/2017 | Courtial | | |

FOREIGN PATENT DOCUMENTS

| | | | |
|---|---|---|---|
| EP | 3251542 | A1 | 12/2017 |
| FR | 1172521 | A | 2/1959 |
| GB | 191500402 | | 12/1915 |
| GB | 241719 | | 10/1925 |
| GB | 1171481 | A | 11/1969 |
| KR | 1020140140259 | A | 12/2014 |

OTHER PUBLICATIONS

Written Opinion on the Patentability of the Invention issued in corresponding French Application No. 2009392 dated Sep. 10, 2021 (6 pages).

* cited by examiner

SNAP BUTTON, AND A FEMALE COMPONENT FOR SUCH SNAP BUTTON

CROSS REFERENCE TO RELATED APPLICATIONS

This application claims priority to Italian Patent Application No. IT102019000016394 filed on Sep. 16, 2019, the entire contents of which are incorporated herein by reference.

FIELD OF THE INVENTION

The present invention relates to a snap button, also referred to as a snap fastener or press stud.

The invention has been developed with particular regard for a female component of a snap button, comprising a resilient member for selective connection to a corresponding male component of the same snap button.

TECHNOLOGICAL BACKGROUND

Snap buttons are widely used to keep fastened two edges of a generic substrate, for example, fabric, plastics material, pelts in various sectors, such as clothing, upholstery and leather goods, to name only the most significant areas.

Snap buttons comprise a male component and a female component. The female component has a housing with an opening, in which the male component can be inserted in order to carry out the closure of the snap button. There is arranged in the housing of the female component at least one resilient member which is configured so as to retain the male component in the female component until the two components are separated by applying thereto a force sufficient to release the male component from the resilient member in the female component.

An extremely large number of configurations of the male and female components of the snap buttons are known. Among them, there are known configurations in which the female component has a system of resilient retention which is constructed by means of two metal wires which are arranged parallel with the sides of a hole in which there is inserted the head of a male component. This type of snap button is subjected to wear as a result of the repeated friction of the head, which is metal, on the metal wires in the female component. Furthermore, the catch action of this snap button during the closing and opening operation is particularly "hard", that is to say, it requires an effort which is relatively high with respect to the travel. This behaviour of the snap button is not appreciated in the sector of leather goods, wherein there are instead required snap buttons which have a soft opening and closing action. In fact, it is known that, in the field of leather goods, there are appreciated magnetic buttons, precisely for the softness characteristics thereof. However, magnetic buttons have a number of disadvantages which make it suitable to replace them with snap buttons. In fact, magnetic buttons have a poor reliability during closing and are weakly resistant to transverse traction forces.

STATEMENT OF INVENTION

An object of the present invention is to overcome the disadvantages of the prior art and to provide a snap button which is reliable and does not suffer significantly from the phenomenon of wear, including for continuous use. Another object of the invention is to provide a snap button which is economical and simple to construct and to fix to a substrate.

Furthermore, the invention is intended to provide a snap button which withstands transverse separation forces well.

In order to achieve these objects and other objects, the invention relates to a snap button as defined in the appended claims. The invention also relates to a female component which is particularly suitable for use in a snap button.

According to a first aspect, there is described a snap button comprising a male component and a female component. The two male and female components are intended to couple and uncouple in order to fasten and unfasten the button. The coupling and uncoupling are brought about as a result of an effort in a main axial direction. This ensures that the opening and closing of the snap button are carried out only in a substantially axial manner, preventing accidental opening if the button in the fastened condition is subjected to a traction in a transverse direction. In this manner, there is obtained good reliability of coupling between the male component and the female component.

The male component comprises a base. A head protrudes from the base. The head, which may be rounded, is provided with a neck which is narrower than the head. The female component comprises a hollow body. The hollow body has an opening which has such dimensions that the head of the male component can be introduced therein. Two flexible bars are arranged in the hollow body. The flexible bars may have a circular cross-section or a cross-section which is shaped differently, an asymmetric shape. The flexible bars are of a plastics material. The flexible bars are mounted in the hollow body, with the ends thereof blocked in housings formed in the hollow body so as to be able to bend in a central zone thereof. The distance between the two flexible bars is less than the dimension of the head of the male component so that they can be flexibly forced away from each other when the head is forced between the two flexible bars. After the head of the male component has passed the flexible bars, therefore, they can move back towards each other resiliently. Particularly when the button is coupled, the flexible bars can resiliently move back towards each other at the neck of the male component.

For the same pushing or pulling force necessary for engaging or disengaging the male component from the female component, respectively, the flexible bars of plastics material can be produced with a much greater diameter than similar components produced from a metal wire. This brings about the increase of the percentage of deformation which can be withstood by the flexible bars while remaining in a resilient range. The use of flexible bars of plastics material, particularly though not exclusively of acetal resin, is particularly advantageous with respect to using flexible bars of metal. In fact, using flexible bars of plastics material brings about greater flexion of the flexible bars and therefore a greater travel which is available during the insertion and withdrawal operation of the head of the male component into/out of the female component.

From another perspective, for the same diameter the flexible bars of plastics material require a smaller effort in order to engage and disengage the male component from the female component with respect to similar bars of metal material. An important advantage is the great reduction of the occurrences of friction and the greater resistance to wear of the snap button which uses bars of plastics material, in comparison with conventional systems in which the friction of metal on metal during use generates early wear of the components. The reduction of problems of wear is ensured in the present description by the friction of the head, which is made of metal, on elements of plastics material, that is to say, the flexible bars. The friction is reduced not only as a result of the difference of the materials, but also because the flexible bars of the female component have a greater range of deformability than similar metal bars, and therefore generate during use substantially smaller occurrences of friction than metal bars.

All the factors set out above result in a greater ease of use of the snap button, particularly in the coupling step, that is to say, fastening, wherein a smaller application pressure is required, which is particularly appreciable in the sector of leather goods, where a soft catch action is required and appreciated for the closure, for example, of a flap of a bag.

According to a specific aspect, the flexible bars are made from acetal resin. This material is particularly suitable for processing, is resistant and is suitable for constructing buttons with a predetermined hardness of catch action which can be repeated and readily modified during design.

According to a particular feature, the distance between the two flexible bars substantially corresponds to the transverse dimensions of the neck of the male component. In this manner, the flexible bars are not subjected to deformation in the condition in which the snap button is fastened, with resultant greater reliability and durability over time.

According to another feature, the hollow body of the female component comprises a basin-like body which is shaped to house the flexible bars with their ends being locked. The construction of a basin-like body which integrally comprises the housings of the flexible bars simplifies the production and the assembly of the female component.

According to another feature, the hollow body of the female component is closed by a plate opposite a wall on which the opening is formed for the introduction of the head of the male component. The closure plate simplifies the assembly of the female component and in particular the positioning of the flexible bars inside the basin-like body, which are then retained in position by the closure plate.

According to another feature, on the closure plate of the basin-like body there is provided an opening which is coaxial with the opening on the basin-like body. This opening in the closure plate is advantageous for the at least partial introduction of the head of the male component when it is introduced into the female component when the two components are coupled to each other when the snap button is fastened. This allows the production of a snap button which is quite compact in an axial direction while producing the head of the male component with dimensions which are relatively extensive for easier engagement and disengagement of the two components.

According to another feature, the opening in the hollow body of the female component is a hole. The distance between the flexible bars is less than the diameter of the hole. This configuration simplifies the coupling of the male component and the female component and is particularly simple to produce, as well as being aesthetically pleasing.

According to another feature, the male component and the female component comprise connection members for connecting to a respective plate for fixing on a substrate. Preferably, the connection members are pins which engage in housings arranged on the respective plate. The connection of the male component and the female component is thereby very secure, which is especially appreciated for use on leather substrates and the like in the sector of leather goods, wherein the substrates to which the snap buttons are intended to be applied are relatively thick and rigid.

BRIEF DESCRIPTION OF THE DRAWINGS

Additional features and advantages will be appreciated from the following detailed description of a preferred embodiment, with reference to the appended drawings, given by way of non-limiting example, in which.

DETAILED DESCRIPTION OF PREFERRED EMBODIMENTS

Figure 2:
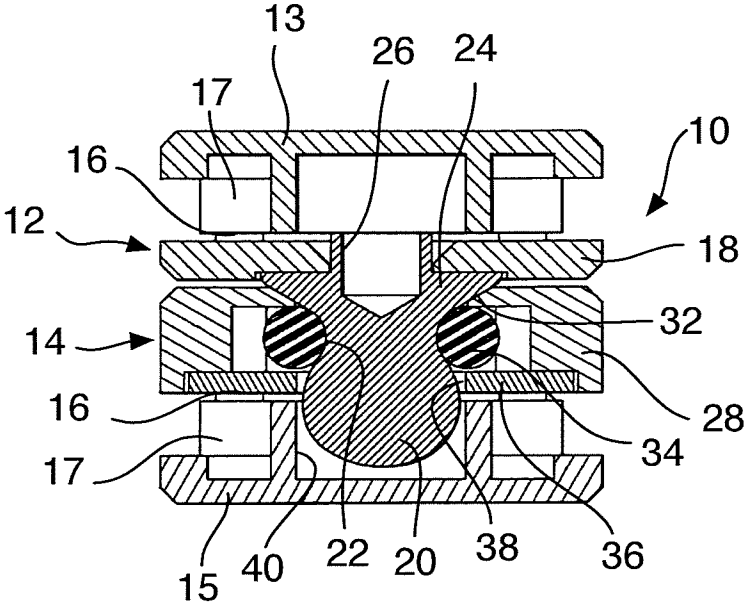
FIG. 2 is a cross-section of the snap button of FIG. 1 in the fastened configuration, wherein the male component and the female component are joined together, and wherein the depiction of the substrate edges has been omitted for clarity of illustration.
Figure 1:
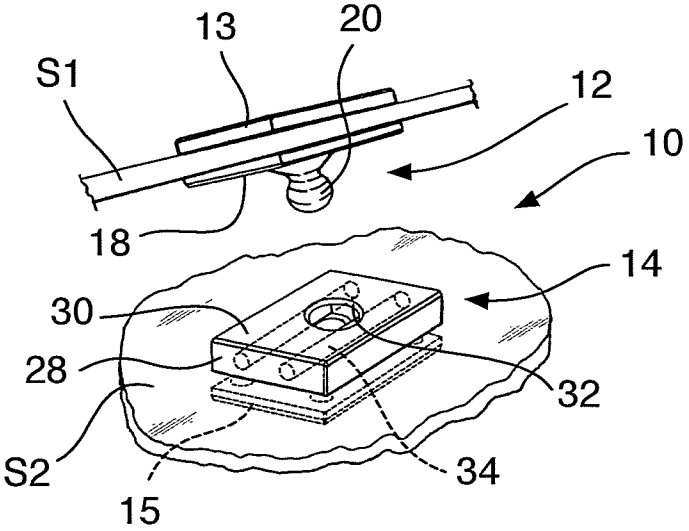
FIG. 1 is a view of a snap button incorporating aspects of the present invention, in the unfastened configuration in which the male component and the female component which are fixed to respective substrate edges are separated from each other.
Figure 4:
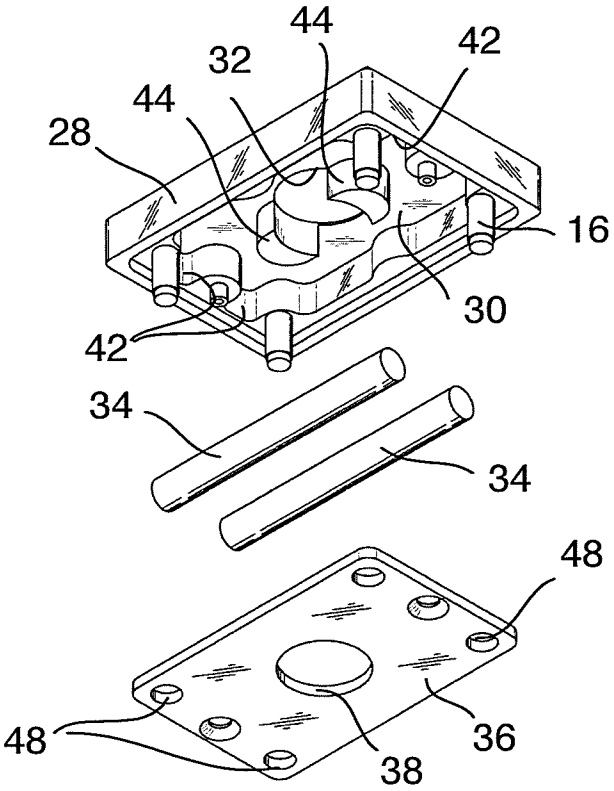
FIG. 4 is an exploded, perspective view of a first embodiment of the female component of the snap button of the preceding figures, wherein the resilient retention elements of the male component can be seen in greater detail.
Figure 3:
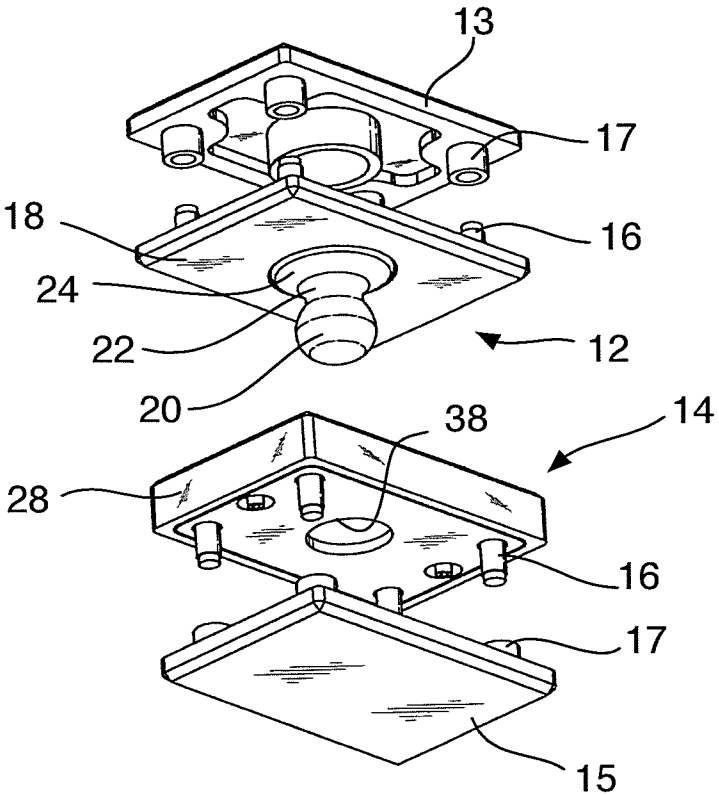
FIG. 3 is an exploded, perspective view of the male component and the female component of the preceding figures, wherein the members for anchoring to the substrate edges can be seen in greater detail.

With reference now to FIGS. 1 to 4, a snap button 10, which is also known as a press stud or snap fastener, comprises a male component 12 and a female component 14. The male component 12 and the female component 14 are provided to be fixed to respective substrate edges S1, S2. The fixing is carried out with systems of the type generally known in the sector. By way of example, the figures illustrate anchoring members 13, 15 in the form of plates, for example, a metal plate or a plate of another aesthetically pleasing material, which are arranged at the side opposite the substrate edges S1, S2 with respect to the male component 12 and the female component 14, with which they are engaged, for example, by means of pins 16 which are press-fitted in metal tubes 17. Naturally, there may be provided different engaging members, such as nails, screws, rivets and other similar systems. The anchoring solution illustrated is particularly advantageous when the substrate to which the snap button is fixed is a hide or other substrate which is relatively thick. In this case, the substrate is drilled beforehand at the pins 16, using, for example, a drilling jig or an equipment item which is provided for the purpose. The anchoring members 13, 15 are preferably, but not necessarily, identical to each other, from the aesthetic perspective and/or functional perspective. Naturally, the shape, dimensions and materials of the anchoring members 13, 15 may be of different types, on condition that the functionalities of good anchoring are preserved.

The male component 12 comprises a base 18. A head 20 projects from the base 18 at the side opposite the pins 16. The head 20 is preferably, but not necessarily, spherical, with a narrower neck 22 which is arranged near the base 18. A collar 24 widens from the neck 22 and is supported on the base 18. A handle 26, which is fixed to the base 18, projects from the collar 24, for example, with an interference fit, by means of welding, threading, clinching or other known means.

The female component 14 comprises a basin-like body 28 with a wall 30, which is preferably but not necessarily planar. There is formed in the wall 30 a hole 32 which is intended to receive the head 20 of the male component 12 in the fastened configuration of the snap button 10. Preferably, the hole 32 widens in a manner complementing the conicity of the collar 24 of the male component 12 in order to improve the stability of the connection in the fastened configuration of the snap button 10. Inside the female component 14, in the basin-like body 28, there are provided two flexible bars 34, which are mutually parallel and arranged to be equidistant from the centre of the hole 32. The distance which separates the two flexible bars 34 is less than the diameter of the head 20 of the male component 12 and substantially corresponds to the diameter of the neck 22. The basin-like body 28 which contains the flexible bars 34 is closed by a plate 36, for example, which is screwed to the basin-like body 28 or fixed thereto in another known manner. The plate 36 has a hole 38 which is aligned with the hole 34 in the basin-like body 32, from which the head 20 of the male component 12 can project in the fastened configuration of the snap button 10, which is thereby particularly compact in an axial direction. In order to further reduce the axial spatial requirement of the snap button 10 in the fastened configuration, it is also possible to construct in the substrate edge S2, on which the female component 14 is fixed, a hole or housing in which the head 20 can be partially received. To this end, there can project from the anchoring member 15 a cup-like body 40 which is intended to be introduced into the hole of the substrate edge S2 in order to receive the head 20 therein.

Inside the basin-like body 28 there are provided two pairs of opposing recesses 42, in which the ends of the flexible bars 34 are received. Two supporting extension pieces 44 of the central zone of the plate 36 project from the wall 30, at the side of the hole 32. The pins 16 project from the basin-like body 28 and extend through respective holes 48 which are formed in the plate 36.

The flexible bars 34 are constructed from plastics material, for example, an acetal resin or other synthetic materials. The diameter of the flexible bars 34 is selected to provide predetermined resilient behaviour in accordance with the hardness of fastening and unfastening which is intended to be carried out in the specific snap button. In fact, when the snap button 10 is fastened, the insertion of the head 20 of the male component 12 in the hole 32 of the female component 14 initially brings about the mutual movement apart of the two flexible bars 34 which return to resiliently approach each other, substantially taking up the rectilinear configuration by being compressed on the neck 22 of the male component 12 in order to thus keep the snap button 10 fastened. The resilient behaviour of the flexible bars 34 when they are moved apart from the head 20 of the male component 12 determines the fastening and unfastening hardness, that is to say, the force necessary to couple or uncouple the two male 12 and female 14 components of the snap button.

Figure 6:
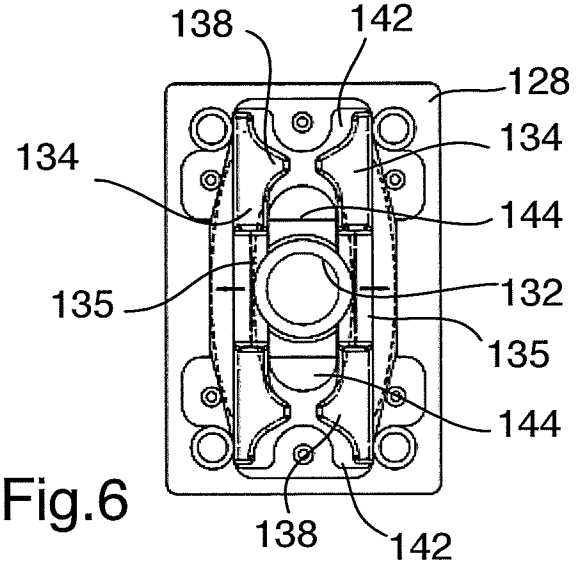
FIG. 6 is a plan view of the female component of FIG. 5, without the covering plate in order to show the internal components and in particular the positioning of the shaped resilient retention elements of the male component.
Figure 5:
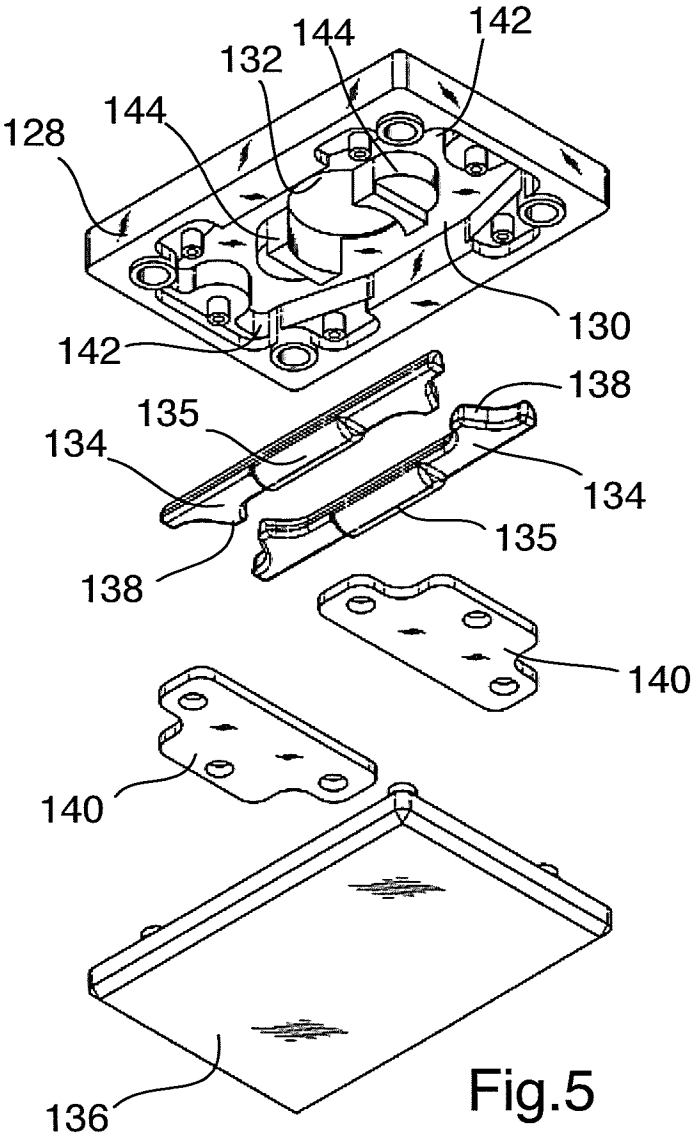
FIG. 5 is an exploded, perspective view, which illustrates similarly to FIG. 4 a second embodiment of the female component of the snap button, with shaped resilient retention elements of the male component.

FIGS. 5 and 6 illustrate another embodiment of the female component. The female component comprises a basin-like body 128 with a wall 130, which is preferably but not necessarily planar. There is formed in the wall 130 a hole 132 which is intended to receive the head 20 of the male component 12 in the fastened configuration of the snap button 10. Preferably, the hole 132 widens in a manner complementary to the conicity of the collar 24 of the male component 12 in order to improve the stability of the connection in the fastened configuration of the snap button 10. Inside the female component, in the basin-like body 128, there are arranged two flexible bars 134, which are mutually parallel and arranged to be equidistant from the centre of the hole 132. The flexible bars 134 have a generally flattened formation, except in a central zone 135 thereof, where they engage with the head 20 of the male component 12, in which they have an enlarged portion having a substantially semi-cylindrical or in any case rounded form in order to promote the engagement with the male component.

The distance which separates the two flexible bars 134 in the central zone 135 is less than the diameter of the head 20 of the male component 12 and substantially corresponds to the diameter of the neck 22. The basin-like body 128 which contains the flexible bars 134 is closed by a plate 136 which is, for example, screwed to the basin-like body 128 or fixed thereto in another known manner. In the embodiment of FIGS. 5 and 6, the plate 136 is closed, even though it can take up the formation of the plate 36 described above.

There are provided inside the basin-like body 128 two pairs of opposing recesses 142 in which the ends of the flexible bars 134 are received. Each flexible bar 134 has near each of the ends thereof a planar protuberance 138 which is smoothed or rounded and which projects towards a corresponding protuberance 138 on the opposite flexible bar 134. The protuberances 138 provide for the flexible bars 134 to rotate about the longitudinal axis thereof when the head 20 of the male component 12 is introduced into or withdrawn from the female component. Two plates 140 are fixed to the basin-like body 128, for example, with screws or rivets, in order to block the ends of the flexible bars 134. Two supporting extension pieces 144 of the central zone of the plate 136 project from the wall 130, beside the hole 132.

As in the previously described embodiment, in this case the flexible bars 134 are also constructed from plastics material, for example, an acetal resin or other synthetic materials. The dimensions of the flexible bars 134, and particularly the cross-section, width thereof and the enlarged portion in the central zone 135 thereof, are selected to provide a predefined resilient behaviour in accordance with the hardness of fastening and unfastening which is intended to be brought about in the specific snap button, which interacts with the flexible bars 134 in a similar manner to that described above.

Figure 7:
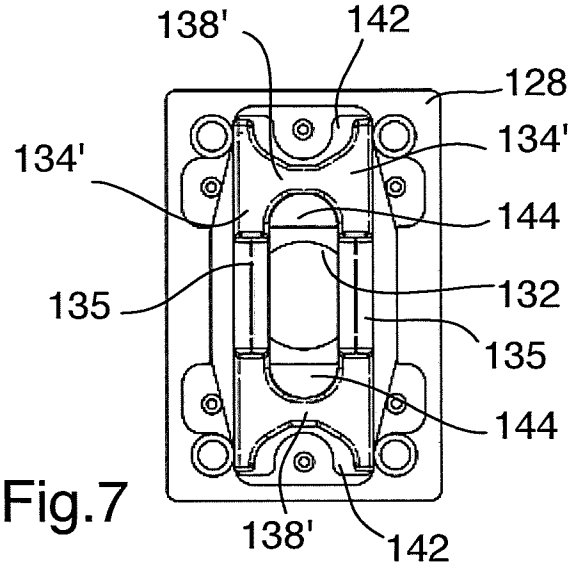
FIG. 7 is a plan view of the female component also without the covering plate similarly to FIG. 6, with an alternative form of resilient retention elements of the male component.

With reference now to FIG. 7, there is illustrated a variant of the embodiment of FIGS. 5 and 6, wherein identical numerals correspond to identical elements. In this variant, there are provided two flexible bars 134' which are joined to each other at the planar projections 138' which merge in order to generally form a closed ring-like structure which is very resistant to the torsion applied to the bars 134' during the action of insertion and withdrawal of the head 20 of the male component 12.

Figure 8:
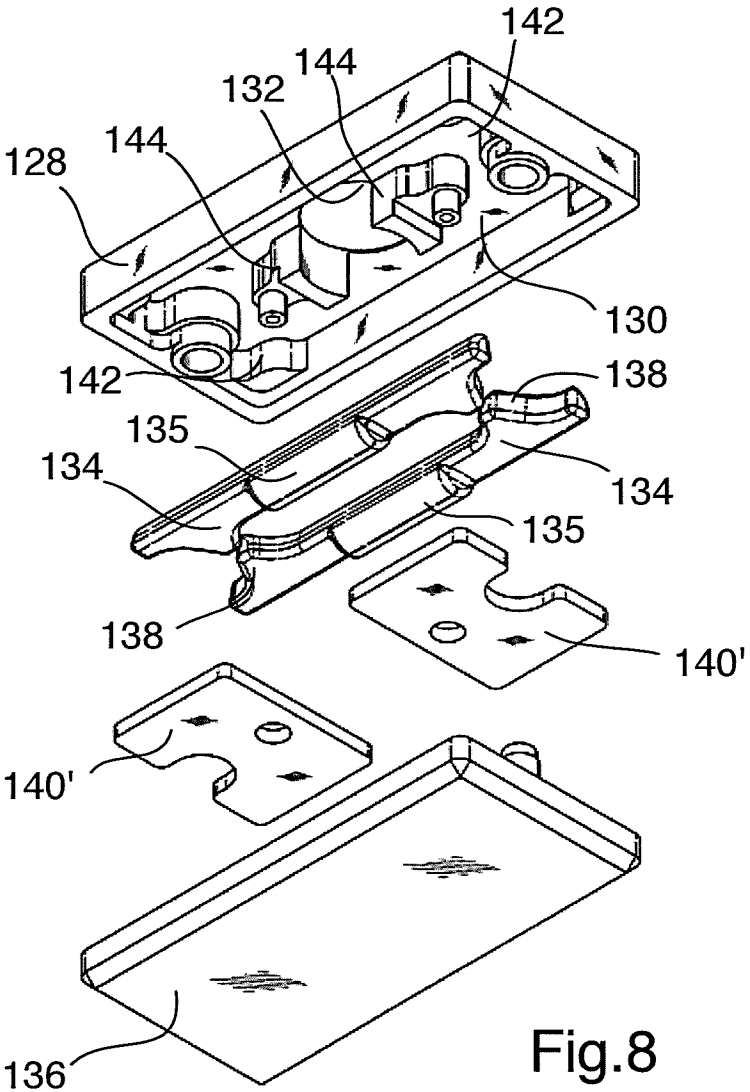
FIG. 8 is an exploded, perspective view, which illustrates another embodiment of the female component of the snap button.

FIG. 8 illustrates an embodiment of the female component which differs from the one in FIGS. 5-7 in that the basin-like body is narrower and more compact. In this case, the plates 140' which clamp the ends of the flexible bars 134 are fixed to the basin-like body 128 with a single central screw or rivet. The plate 136 is also fixed to the basin-like body 128 only with two screws or rivets which are located on a line of central symmetry of the female component. The flexible bars 134 are closer together than in the embodiment of FIGS. 5-7 and are suitable for use in buttons having dimensions which are very small.

Figure 9:
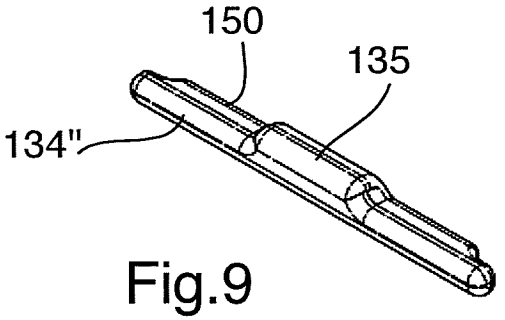
FIGS. 9 and 10 are perspective views of two variants of shaped resilient retention elements of the male component.

The resilient bars can take up other configurations with respect to the ones described above. For example, as can be seen in FIG. 9, each resilient bar 134" may comprise an elongate cylindrical member, from which there projects laterally an elongate extension piece 150 which serves both to reinforce the resilient bar 134", partially determining the resilient flexion behaviour, and to prevent the rotation thereof following the torsion applied by the head 20 of the male component 12 during the action of introduction and withdrawal from the female component.

Figure 10:
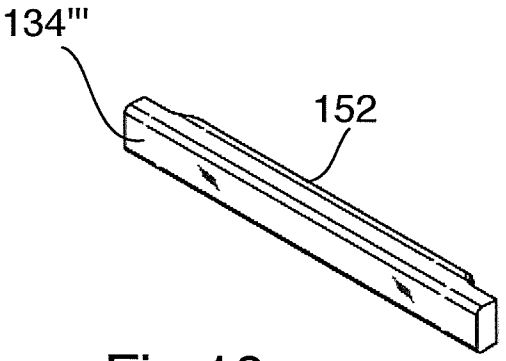

FIG. 10 shows another example of a resilient bar 134''' which can be used in a female component. The resilient bar 134''' comprises an elongate member with a rectangular cross-section, from which there laterally projects an elongate extension member 152 which also in this case serves to reinforce the resilient bar 134''', partially determining the resilient flexion behaviour.

For the same pushing or pulling force necessary for engaging or disengaging the male component from the female component, respectively, of any one of the above-described embodiments, the flexible bars of plastics material have a diameter or cross-section which is far greater than similar components constructed from a metal wire, which also determines the increase of the percentage of deformation which can be withstood by the flexible bars while remaining in the resilient range. The use of flexible bars of plastics material, particularly though not exclusively of acetal resin, is particularly advantageous with respect to using metal material because with the first material there is obtained during use a greater flexion of the flexible bars, and therefore a greater available travel during the insertion and withdrawal operation of the head of the male component in the female component. Accordingly, for the same diameter or cross-section of the flexible bars of resin with respect to bars of metal, a smaller force is necessary to engage and disengage the male component from the female component.

An important advantage is the strong reduction of the friction and the greater resistance to wear of the snap button which uses resilient bars of synthetic material, plastics material or resin, when compared with conventional systems where the friction of metal on metal during use generates early wear of the components. The reduction of problems of wear is ensured in the present invention by the friction of the head of the male component, which is made of metal, on the flexible bars of the female component, which are plastics material elements. Not only is the friction reduced as a result of the diversity of the materials, but also because the flexible bars, having a range of deformability which is greater than similar metal bars, generate during use friction which is substantially less than them.

All the factors set out above result in a greater ease of use of the device, particularly during closure, that is to say, fastening, which requires a smaller application pressure, which is particularly appreciable in the sector of leather goods, where the closure, for example, of a flap of a bag, preferably has to require a soft catch action.

The present invention further ensures that both the opening and the closing of the snap button are carried out only in a substantially axial manner, preventing the accidental opening if the button in the fastened condition is subjected to a traction in a transverse direction.

Naturally, the principle of the invention remaining the same, the forms of embodiment and details of construction may be varied widely with respect to those described and illustrated, without thereby departing from the scope of the present invention.

The invention claimed is:

1. A snap button comprising a male component and a female component intended to couple and uncouple as a result of an effort in a main axial direction, the male component comprising a base from which there protrudes a rounded head, which is provided with a neck which is narrower than the head, the female component comprising a hollow body with an opening within which the head of the male component can be introduced, two flexible bars of a plastics material, the flexible bars being separate components from the hollow body and being mounted in the hollow body, each of the flexible bars having ends blocked on the hollow body and a central zone configured to freely bend, a distance between the flexible bars being less than a dimension of the head of the male component so that the flexible bars can be flexibly forced in their respective central zone away from each other by a force exerted by the head of the male component and resiliently move back towards each other when the force exerted by the head of the male component stops.

2. The snap button according to claim 1, wherein the flexible bars are made of an acetal resin.

3. The snap button according to claim 1, wherein the flexible bars have a circular cross-section.

4. The snap button according to claim 1, wherein the flexible bars have an asymmetric cross-section.

5. The snap button according to claim 1, wherein the distance between the two flexible bars substantially corresponds to transverse dimensions of the neck of the male component.

6. The snap button according to claim 1, wherein the hollow body of the female component comprises a basin-shaped body which is shaped to house the flexible bars and to lock the ends thereof on the hollow body.

7. The snap button according to claim 6, wherein the female component comprises a plate and the hollow body includes a wall in which the opening is formed for the introduction of the head of the male component and the plate is disposed opposite the wall of the hollow body and closes off one side of the hollow body, the flexible bars being disposed between the wall and the plate.

8. The snap button according to claim 7, Wherein the plate has an opening which is coaxial with the opening in the hollow body, for the at least partial introduction of the head of the male component into the female component when the male component and the female component are coupled to each other.

9. The snap button according to claim 1, wherein the opening in the hollow body of the female component comprises a hole, the distance between the flexible bars being less than a diameter of the hole.

10. The snap button according to claim 1, wherein the male component comprises an anchor plate and connection members interconnecting the anchor plate to the base, and the female component to the hollow body, the connection members being configured for fixing the male component and the female component on respective substrates.

11. The snap button according to claim 10, wherein the connection members of the male component and the female component comprise pins, and the anchor plates of the male component and the female component comprise housings, the pins of the male component being disposed on the base and engaging in the housings of the anchor plate of the male component, the pins of the female component being disposed on the hollow body and engaging in the housings of the anchor plate of the female component.

12. A female component for a snap button, the female component comprising a hollow body with an opening within which a head of a male component can be introduced, two flexible bars of a plastics material, the flexible bars being separate components from the hollow body and being mounted in the hollow body, each of the flexible bars having ends blocked in the hollow body and a central zone configured to freely bend, a distance between the flexible bars in the central zone being less than a dimension of the head of the male component so that the flexible bars can be flexibly forced away from each other in the central zones thereof by a force exerted by the head of the male component and resiliently move back towards each other when the force exerted by the male component stops.

13. The female component according to claim 12, wherein the flexible bars are made of an acetal resin and have a circular cross-section or an asymmetric cross-section.

14. The snap button according to claim 1, wherein the hollow body comprises mounting elements configured for lockingly engaging the ends of the flexible bars to secure the flexible bars in the hollow body.

15. The snap button according to claim 14, wherein each of the mounting elements comprises a recess configured for receiving one of the ends of the flexible bars.

16. A snap button, the snap button comprising:

a male component comprising a base, a fastening element fixed to and protruding from the base, the fastening element having a rounded head and a neck connected thereto, the neck having a dimension narrower than a dimension of the head and being disposed between the base and the head;

a female component comprising a main body including a wall defining a hollow interior, the wall of the main body defining therein an opening for receiving the fastening element of the male component; and a pair of bars constructed of flexible plastic, the bars being disposed in the hollow interior of the main body of the female component adjacent respective opposite sides of the opening and being separate components from the main body, each of the bars having a pair of opposite ends secured in the main body of the female component and a bendable central area disposed between the opposite ends, the bars being disposed in the main body at a distance from one another, the distance being less than the dimension of the head of the male component such that a coupling or uncoupling of the male component and the female component, during which the fastening element of the male component is inserted into the opening of the female component or is removed from the opening of the female component, respectively, causes the bars in the central areas thereof to move away from one another due to a force exerted by the fastening element thereon, the bars moving back towards one another when the force is removed.

17. The snap button according to claim 16, wherein the main body comprises mounting elements configured for lockingly engaging the ends of the bars to secure the bars in the main body.

18. The snap button according to claim 17, wherein each of the mounting elements comprises a mounting recess configured for receiving one of the ends of the bars.

19. The snap button according to claim 16, wherein the male component comprises an anchor member disposed in opposed relation with and connected to the base, the anchor member and/or the base being configured for fixing a first substrate, to be fastened to a second substrate by the snap button, therebetween, the female component comprising an anchor member disposed in opposed relation with and connected to the main body, the anchor member of the female component and/or the main body being configured for fixing the second substrate therebetween, the hollow interior of the main body of the female component opening through one side of the main body which faces away from the male component when coupled to the female component, the female component comprising a plate disposed in opposed relation with the wall and between the wall and the anchor member of the female component so as to close off the hollow interior of the main body, the plate defining a hole therein aligned with the opening of the wall of the main body for at least partially receiving the head of the fastening element.

20. The snap button according to claim 16, wherein the bars are configured for rotation relative to the main body.

21. The snap button according to claim 16, wherein the bars are interconnected to one another adjacent the ends thereof so as to form a closed ring-shaped structure.

* * * * *